US005810612A

United States Patent [19]

Flask et al.

[11] Patent Number: 5,810,612

[45] Date of Patent: Sep. 22, 1998

[54] ELECTRICAL CONNECTOR WITH CAM LOCK LEVER

[75] Inventors: William George Flask, Youngstown; John Henry Bakker; William Keith Clupper, both of Cortland, all of Ohio; Donald John Mizner, Sharpsville, Pa.

[73] Assignee: General Motors Corporation, Detroit, Mich.

[21] Appl. No.: 703,226

[22] Filed: Aug. 26, 1996

[51] Int. Cl.[6] ..... H01R 13/62

[52] U.S. Cl. ..... 439/157; 439/372

[58] Field of Search ..... 439/157, 153, 439/155, 160, 310, 372, 358

[56] References Cited

U.S. PATENT DOCUMENTS 2,955,273 10/1960 Winkler ..... 439/153

*Primary Examiner*—P. Austin Bradley
*Assistant Examiner*—Tho Dac Ta
*Attorney, Agent, or Firm*—Anthony Luke Simon

[57] ABSTRACT

An electrical connector comprising: a connector housing having first and second opposing sides; on each of the first and second sides, a flex arm having a first end, a second end and a central portion between the first and second ends wherein a flexible member connects the central portion of the flex arm to the side; a cam lock lever comprising first and second lever arms and a handle connecting the first and second lever arms wherein the first lever arm is pivotably mounted to the first side and the second lever arm is pivotably mounted to the second side, wherein the cam lock lever is pivotable between a first state in which it is open and a second state in which it is closed; on each of the first and second arms, first and second cam lock seats; and on each of the first ends of the first and second flex arms, first and second locks wherein when the cam lock lever is in the first state, each first lock engages one of the first seats and when the cam lock lever is in the second state, each second lock engages one of the second seats.

4 Claims, 2 Drawing Sheets

ELECTRICAL CONNECTOR WITH CAM LOCK LEVER

This invention relates to an electrical connector.

BACKGROUND OF THE INVENTION

Known electrical connector systems such as those used with automotive vehicle electrical harnesses typically comprise plastic housings for male and female connectors that fasten together to secure coupling of terminals mounted within the housings. Many male and female connector pairs require a high amount of force to completely engage, resulting in large exertion by the person assembling the connectors together.

To reduce the amount of effort required to assemble connectors while ensuring secure connections, some connectors are provided with cam lock features. Cam lock features typically include one or more cam surfaces on an operator handle or lever that is mounted to the housing of one of the connectors to be mated. The other connector housing has one or more protruding cam followers to engage the cam surface(s) so that, as the lever or handle is moved in the desired direction, the cam surface(s) act on the cam follower(s), drawing the connector housings together and forcing secure engagement thereof.

SUMMARY OF THE PRESENT INVENTION

It is an object of this invention to provide an electrical connector according to claim 1.

Advantageously, this invention provides an electrical connector with a cam lever that functions to transfer rotary motion of the cam lever into linear movement between the connector and a mating connector, facilitating secure engagement of the two connectors and reducing the amount of operator exertion required when making the secure engagement.

Advantageously, this invention provides an electrical connector with a cam lever securable in two positions, a first pre-stage position and a final closed position.

Advantageously, according to this invention, a cam lever is pivotably mounted to a connector housing that has flex arms that carrying locks for the cam lever. The flex arms each have a pre-stage lock to lock the cam lever in an open position and a final position lock to lock the lever in a closed position. These features allow the cam lever to be mounted to the housing and secured in an open position during pre-assembly and then allow the cam lever to be easily released and pivoted to the closed position during engagement with the mating connector. Once in the closed position, the cam lever is locked in place to provide position assurance of the mating connectors.

The advantages described herein are provided in a preferred example connector according to this invention comprising: a connector housing having first and second opposing sides; on each of the first and second sides, a flex arm having a first end, a second end and a central portion between the first and second ends wherein a flexible member connects the central portion of the flex arm to the side; a cam lock lever comprising first and second lever arms and a handle connecting the first and second lever arms wherein the first lever arm is pivotably mounted to the first side and the second lever arm is pivotably mounted to the second side, wherein the cam lock lever is pivotable between a first state where it is open and a second state where it is closed; on each of the first and second arms, first and second cam lock seats; on each of the first ends of the first and second flex arms, first and second locks wherein when the cam lock lever is in the first state, each first lock engages one of the first seats and when the cam lock lever is in the second state, each second lock engages one of the second seats.

BRIEF DESCRIPTION OF THE DRAWINGS

The present invention will now be described by way of example with reference to the following drawings in which.

DETAILED DESCRIPTION OF THE INVENTION

Figure 1:
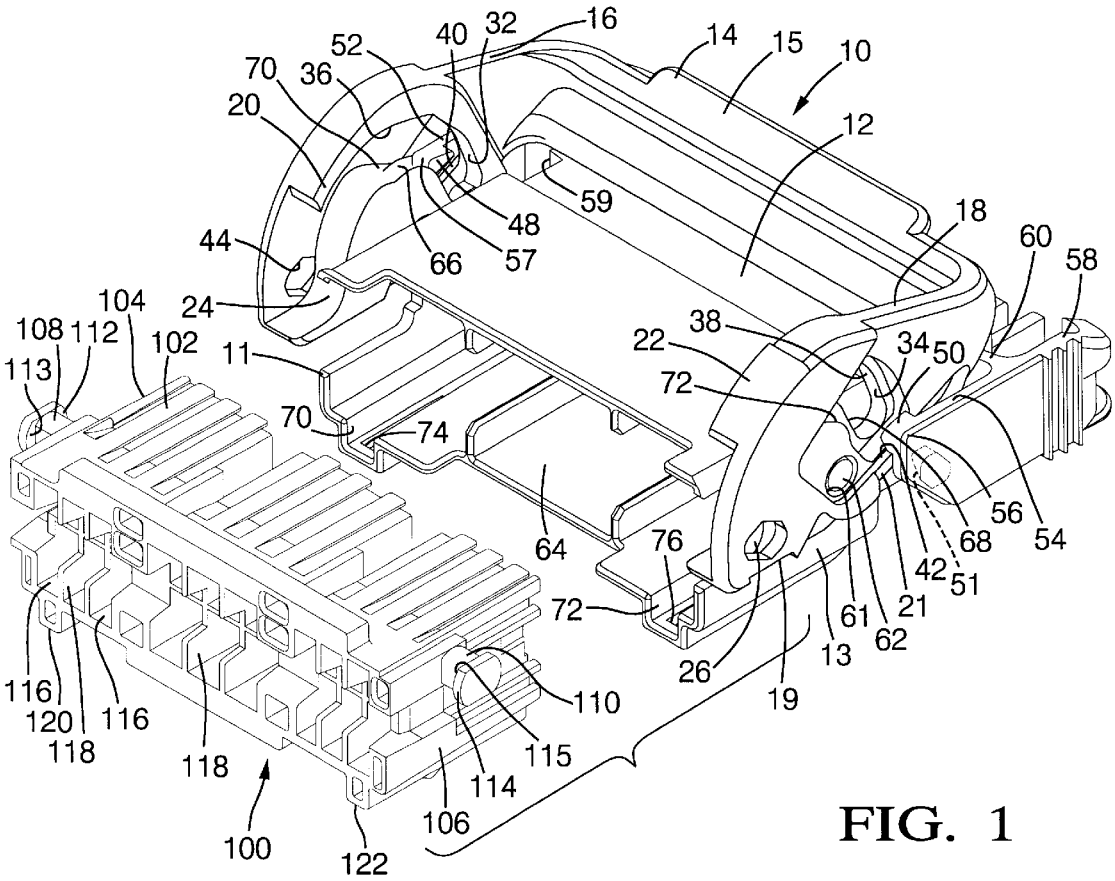
FIG. 1 illustrates an example connector according to this invention.

Referring now to FIG. 1, mating connectors 10 and 100 engage using a cam lock. The connectors 10 and 100 are shown without the terminals or harness wires to avoid cluttering but it will be understood by those skilled in the art that terminals of a known type for terminating harness wires are implemented in the connectors in a known manner. The connector 10 comprises housing 12 and cam lever 14 pivotably mounted thereon. The cam lever 14, and the housings 12 and 102 for the connectors 10 and 100 are each preferably integrally molded as single plastic parts.

Cam lever 14 comprises first arm 16 and second arm 18 connected at their ends by the handle portion 15. The cam lever 14 includes on each arm 16, 18 a circular cylindrical opening 61 (only one shown) that operates as a bearing surface riding on a circular cylindrical protrusion 62 (only one shown), one of which extends from side 11 of the housing 12 and the other of which extend from side 13 of the housing 12. Each arm 16 and 18 has an upper cam wall 20, 22, respectively, that follows substantially a partial revolution of a spiral, gradually decreasing in radius from opposite the front portions of walls 24, 26 to slots 32, 34.

The inner cam path is defined by the walls 24 and 26 and the outer cam path is defined by walls 36, 38. Slots 32 and 34 are formed between the walls 24, 26 and the walls 36, 38, respectively. In slot 32, partially through the cam path, inner wall 24 deviates into two walls 66 and 71. Similarly, partially through the cam path of slot 34, inner wall 26 divides into two walls 68 and 73. The interior slot walls 66, 68 define the cam paths for the bodies of cam followers 108 and 110 on connector 100. The vertical walls between the interior slot walls 66, 68 and the recessed walls 71, 73 form sliding surfaces for the shoulders 113, 115 between the cam followers 108, 110 and the ends 112,114 thereof, locking the cams within the slots 32, 34 when the cam lever is moved from the first stage, shown in FIG. 1, to the second or closed stage shown in FIG. 4.

At the ends of the cam slots 32 and 34, locking seats 40 and 42 are provided on the arms 16 and 18 for engaging the locks 48 and 50 extending from the ends of flex arms 52 and 54 when the cam lever 14 is in the open position shown in FIG. 1. Flex arms 52 and 54 are mounted on the sides 11 and 13 of the housing 12, respectively. Each flex arm 52, 54 is mounted to the side 11, 13 by a flexible member 59, 60, which connects the central portion of the flex arm 52, 54 to the side 11, 13.

The flex arms 52 and 54 are integrally molded as part of the housing 12. Each flex arm 52 and 54 has a first end 56 and a second end 58 (only one shown). The locks 48, 50 and 51 are located on the ends 57, 56 of the flex arms 52, 54 and the other ends 58 are used for manual release of the locks 48, 50, 51. For example, to release the locks 48 and 50 from the seats 40 and 42, the flex arms 52, 54 are squeezed together from the release ends 58. In response, each flex arm 52, 54 moves in a pivotable motion about its flexible member 59, 60, moving the locks 48, 50 away from the lock seats 40, 42, releasing the cam lever 14 from the first stage position shown in FIG. 1.

A tapered edge 21 is provided on the arm 18 at a position as shown leading to seat 42 so that as the cam lever 14 is pivoted into the position shown in FIG. 1, the lock 50 is deflected along the tapered edge 21, cantilevering flex arm 54, allowing cam lever 14 to continue pivoting until lock 50 snaps into seat 42. Similar operation occurs with respect to arm 16 and lock 48.

The connector 100 shown generally comprises a housing 102 with first and second sides 104 and 106 from which protrude the cam followers 108 and 110, respectively. The detail of the internal structure of housing 102 is not central to this invention and many variations are known to those skilled in the art with typical housings comprising a plurality of openings 116 divided by a plurality of partitions 118. The openings 116 are adapted for receiving connector terminals (not shown) for terminating electrical harness wires in a known manner and for engaging appropriate mating terminals of a known type (not shown) mounted within the housing 12 of the connector 10.

Figure 2:
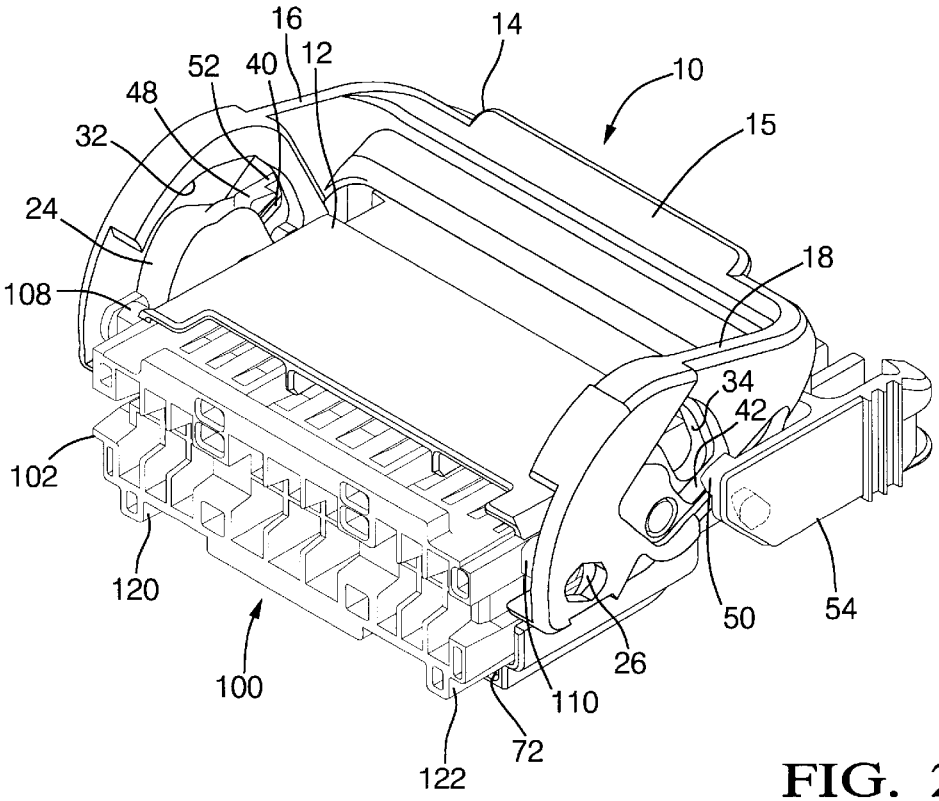
FIGS. 2, 3 and 4 illustrate example cam operation according to this invention.
Figure 3:
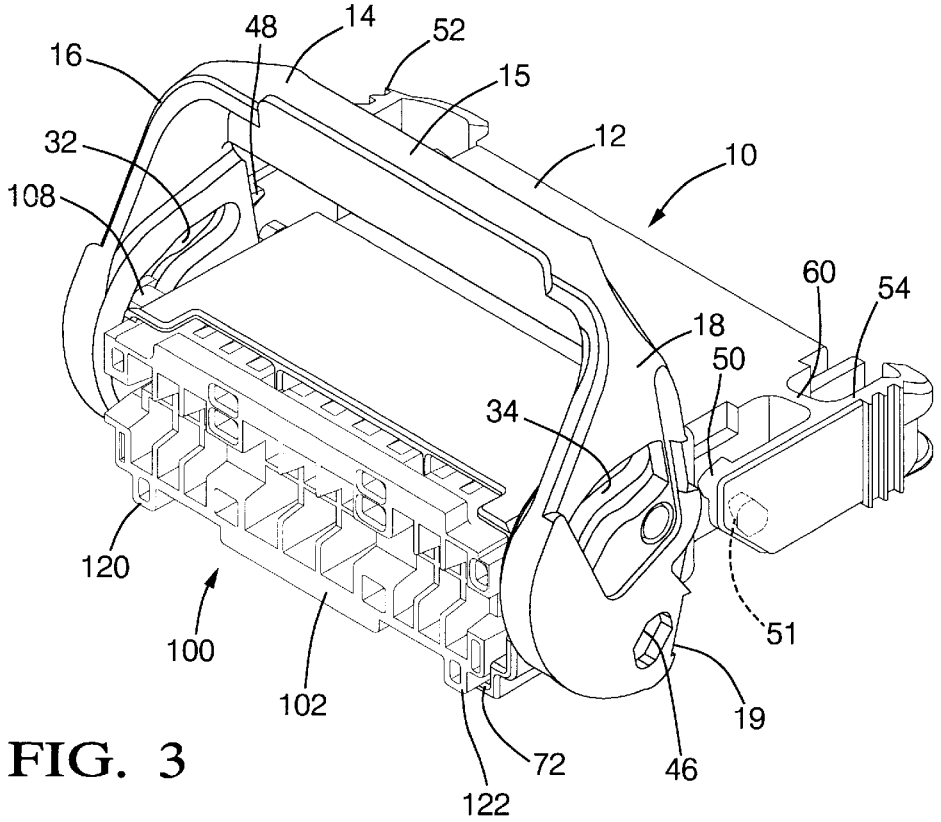
Figure 4:
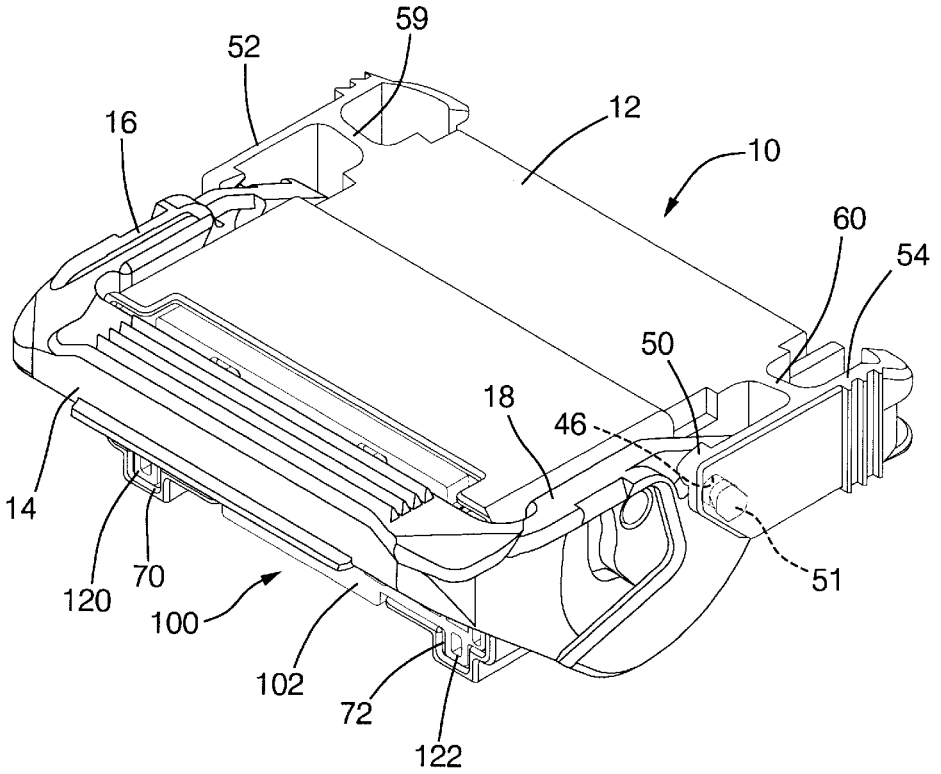

The operation of the cam assist for the connectors can be better understood with respect to FIGS. 2–4. To mate the connectors 10 and 100, the cam lever 14 is provided in the first stage or open position and locked in place as shown in FIG. 2. The connector 100 is slid within the cavity 64 of connector 10 until the cam followers 108 and 110 engage the surfaces 24 and 26, which prevent the connector 100 from being further engaged to connector 10.

In the example shown, slots 70 and 72 are provided on each end of the cavity 64 of housing 12. Keys 120 and 122 are integrally molded into the underneath of housing 102 as shown for engaging into slots 70 and 72 when the housing 102 is slid into the cavity 64. Ramp locks (not shown) of a known type are provided on the underside of each key 120, 122 so that when the connector 100 is in the position shown in FIG. 2, the ramp locks engage in openings 74, 76 in slots 70, 72, providing a moderate retention force for the pre-stage assembly shown in FIG. 2. The openings 74, 76 extend longitudinally along slots 70, 72, allowing the ramp locks to slide therein as the connector 100 is slid within cavity 64 by the operation of cam lever 14 described below.

After the assembly stage shown in FIG. 2 is achieved, the release ends of the flex arm 52 and 54 are compressed, releasing the locks 48 and 50 from the lock seats 40 and 42 and the arms 16 and 18 of the cam lever 14. Alternatively, if the locks 48 and 50 are provided with appropriately tapered leading edges, they can be released from the lock seats 40, 42 by pivoting the cam lever 14.

An operator then pivots cam lever 14 towards its closed position during which process the slots 32 and 34 engage the cam followers 108 and 110, converting the pivoting motion of the cam lever to linear motion and forcing the connector 100 further within connector 10. An intermediate position of lever 14 during the pivoting is shown in FIG. 3.

As the cam lever 14 approaches the position shown in FIG. 4, the tapered leading edge 19 (FIG. 3) on arm 18 deflects lock 51, cantilevering flex arm 54. This allows the pivoting motion of cam lever 14 to continue until lock 51 snaps in place within seat 46. Similar operation occurs between arm 16 and flex arm 52.

When the lever 14 achieves the position shown in FIG. 4, the connectors 10 and 100 are fully engaged through the action of the cam slots on the cam followers 108 and 110. In the second stage shown in FIG. 4, locks 51 (FIG. 1, only one shown) are engaged in the lock seats 44 and 46, maintaining the lever 14 in the second stage until the release ends of the levers 52 and 54 are pressed together releasing the second stage locks 51 from the lock seats 44 and 46. The second stage locks 51 also act as a position assurance in that if the lever 14 is fully drawn to the position shown in FIG. 4 and locked in place, it can be assumed that the connectors 10 and 100 are fully engaged.

The end portions of the slots 32, 34 are preferably linear and oriented so that a pull force acting to separate housings 10 and 100 cannot translate into pivotal motion to back-drive the cam lever 14.

We claim:

1. An electrical connector comprising:

a connector housing having first and second opposing sides;

on each of the first and second sides, a flex arm having a first end, a second end and a central portion between the first and second ends wherein a flexible member connects the central portion of the flex arm to the side;

a cam lock lever comprising first and second lever arms and a handle connecting the first and second lever arms wherein the first lever arm is pivotably mounted to the first side and the second lever arm is pivotably mounted to the second side, wherein the cam lock lever is pivotable between a first state in which it is open and a second state in which it is closed;

on each of the first and second lever arms, first and second cam lock seats; and on each of the first ends of the first and second flex arms, first and second locks wherein when the cam lock lever is in the first state, each first lock engages one of the first seats and when the cam lock lever is in the second state, each second lock engages one of the second seats.

2. An electrical connector according to claim 1, wherein the first locks are releasable from the first seats by pivotal movement of the cam lever.

3. An electrical connector according to claim 1, also comprising:

on each arm, a cam slot bounded by interior and exterior cam walls, wherein the cam slot forms substantially a partial revolution of a spiral.

4. An electrical connector according to claim 3, wherein during pivotal movement of the cam lever, the cam slots act on cam followers to convert the pivotal movement of the cam lever to linear movement of the cam followers.

* * * * *